US006243976B1

(12) United States Patent
Beverly et al.

(10) Patent No.: US 6,243,976 B1
(45) **Date of Patent: *Jun. 12, 2001**

(54) FILL PORT ASSEMBLY FOR A STEAM IRON

(75) Inventors: S. Devon Beverly, Midlothian; Martin Brady, Chesterfield, both of VA (US)

(73) Assignee: Hamilton Beach/Proctor Silex, Inc.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 76 days.

(21) Appl. No.: 09/387,952

(22) Filed: Sep. 1, 1999

(51) Int. Cl.[7] ..... D06G 75/36
(52) U.S. Cl. ..... 38/77.5; 220/213
(58) Field of Search ..... 38/77.1, 77.4, 38/77.5, 77.8; 220/213, 252, 345.1, 345.4, 376

(56) References Cited

U.S. PATENT DOCUMENTS

| | | | | |
|---|---|---|---|---|
| 971,509 | * | 9/1910 | Kramer | 220/345.1 |
| 2,326,886 | * | 8/1943 | Rathbun | 220/252 |
| 3,240,038 | * | 3/1966 | Schwegler | 220/252 X |
| 4,656,763 | * | 4/1987 | Kawasaki et al. | 38/77.8 X |
| 4,748,755 | | 6/1988 | Bain , Jr. et al. . | |
| 4,800,661 | | 1/1989 | Yamamoto et al. . | |
| 5,787,615 | | 8/1998 | Hense et al. . | |
| 5,844,203 | | 12/1998 | Chasen et al. . | |

FOREIGN PATENT DOCUMENTS

| | | | | |
|---|---|---|---|---|
| 144496 | * | 8/1984 | (JP) . | |
| 166199 | * | 9/1984 | (JP) | 38/77.1 |
| 1141692 | * | 6/1989 | (JP) | 38/77.8 |

* cited by examiner

*Primary Examiner*—Ismael Izaguirre
(74) *Attorney, Agent, or Firm*—Roger S. Dybvig

(57) ABSTRACT

A fill port assembly has a base having a recessed pocket with an arcuately concave base wall and mutually parallel sidewalls. A fill port is located intermediate the upper and lower ends of the base wall and a fill port cover is slidably mounted on the sidewalls for movement along an arcuate path from a first, normal, position in which the cover covers the fill port to a second, raised, position in which the cover is located above the fill port and the lower part of the base wall is exposed. In the raised position, the upper end of the cover projects upwardly and forwardly from the pocket so that the front surface of the cover and the lower part of the bottom wall of the pocket form a funnel for directing water into the fill port.

10 Claims, 3 Drawing Sheets

30
26
24
48
66
10
22
64
18
20
36
34
28
38
21
40
46
44
42
16
32
35
12
14

FILL PORT ASSEMBLY FOR A STEAM IRON

FIELD OF THE INVENTION

This invention relates to a fill port assembly for a domestic steam iron, and particularly to a fill port used to pour water into the water reservoir of a steam iron.

BACKGROUND AND SUMMARY OF THE INVENTION

There is an ever-present need to provide improvements in fill ports by which water can be added to a water reservoir of a steam iron. Objects of the present invention are to provide an improved fill port assembly which is convenient to use when filling the water reservoir, adequately protect the water reservoir from being contaminated with air-born substances when the fill port is closed, be attractive in appearance, and be inexpensive to manufacture.

In accordance with this invention, a fill port assembly is provided which comprises a support member having a port-receiving pocket with an arcuately concave base wall and mutually parallel sidewalls. A fill port is located intermediate the upper and lower ends of the base wall and a fill port cover is slidably mounted on the sidewalls for movement along an arcuate path from a first, normal, position in which the cover covers the fill port to a second, raised, position in which the cover is located above at least a portion of the fill port and the fill port and the lower part of the base wall are exposed. When the cover is in the second, raised, position, the upper end of the cover projects upwardly and forwardly from the pocket so that the front surface of the cover and the lower part of the base wall of the pocket form a funnel for directing water into the fill port.

Other objects, advantages and features of this invention will become apparent from the following description and the drawings.

DETAILED DESCRIPTION

Figure 1:
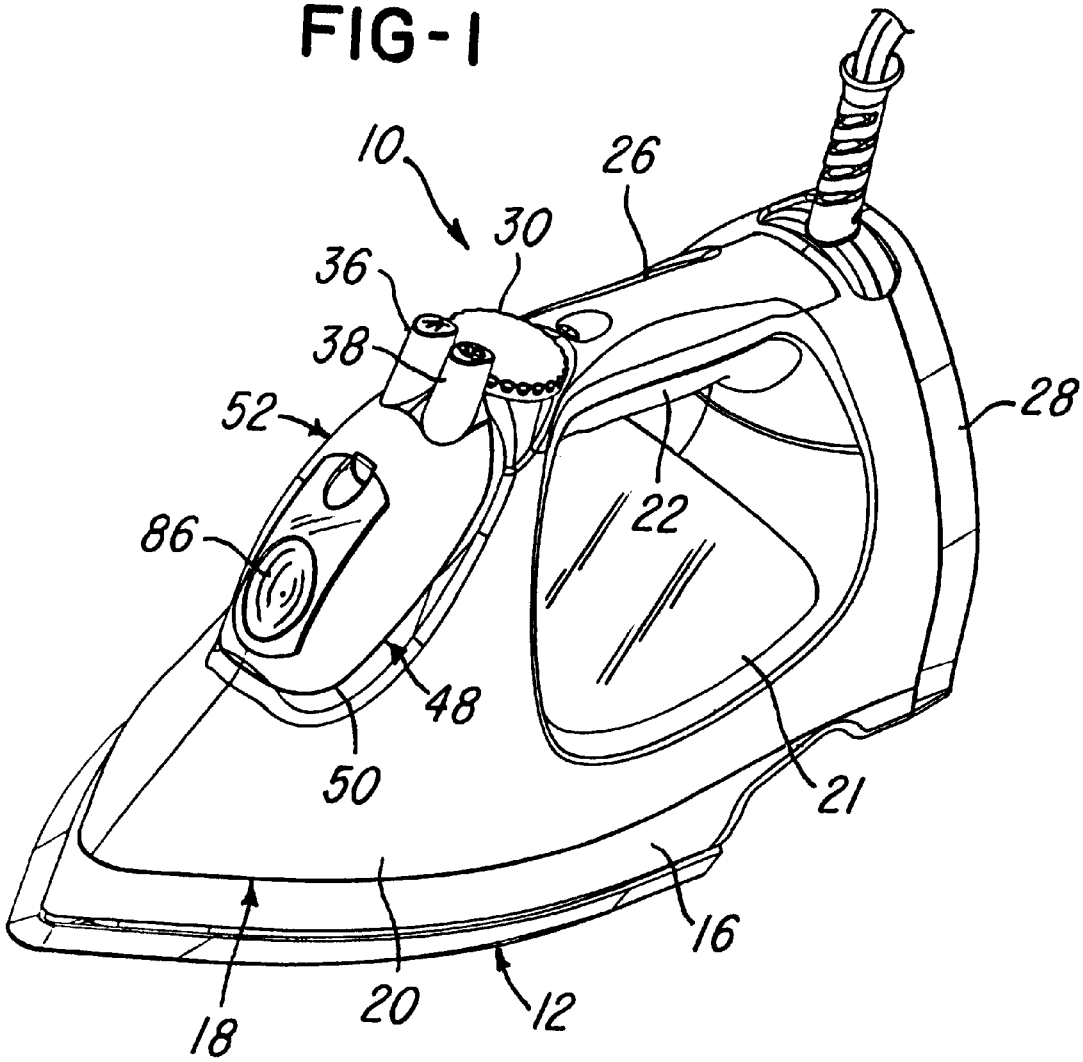
FIG. 1 is a perspective view of a steam iron that has a fill port assembly made in accordance with this invention.
Figure 2:
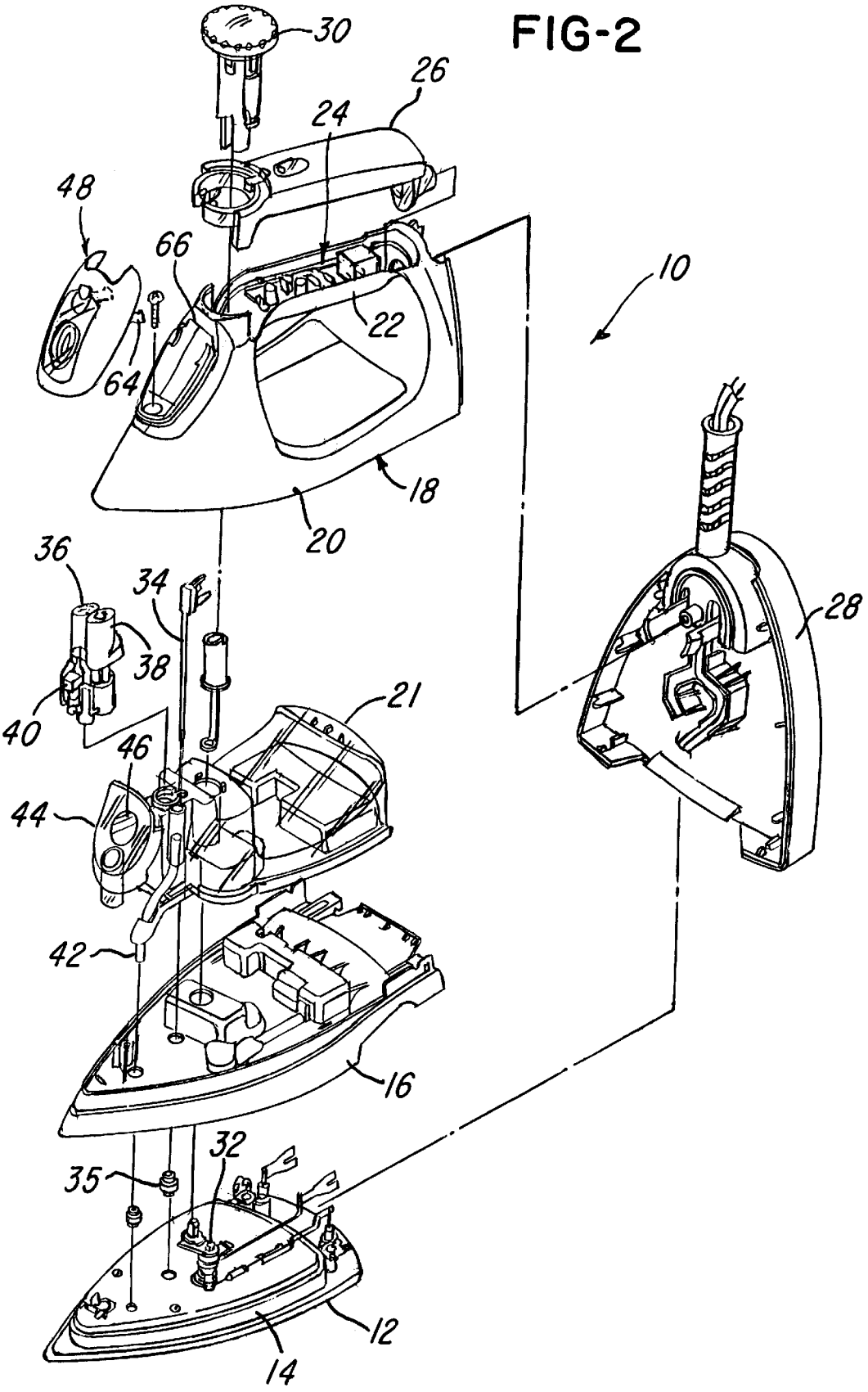
FIG. 2 is an exploded isometric view of the iron of FIG. 1.

With reference to FIGS. 1 and 2, the present invention is illustrated in connection with a household steam iron, generally designated 10, having a soleplate 12 with a steam chamber 14, covered by a base cover 16 which supports a handle 18. Handle 18 has a lower portion 20 which confines a water reservoir 21 and an upper portion 22 which receives an electronic control module 24 and which is covered by a top cover 26. The handle upper portion 22 and the top cover 26 constitute a handgrip. In addition, the iron 10 includes a rear cover 28, a temperature control knob 30 for setting a thermostat 32 mounted on the soleplate 12, and a drip valve assembly including a drip valve stem 34 for dripping controlled quantities of water into the steam chamber 14 through a drip valve seal 35. As well known, the water dripped into the steam chamber 14 is heated by an electrical heating element in the soleplate 12, vaporizes and forms steam which exits from the soleplate 12 through plural steam vents (not shown). The heating element and the electronic controls are connected to house current by means of a power cord connected to the rear cover 28. The particular iron 10 shown in the drawings also has a pair of manually-operable pistons 36 and 38, respectively used to spray water forwardly of the iron through a nozzle 40 and to create a burst of steam by pumping water by way of a thermoplastic tube connection 42 into the steam chamber 14.

The water reservoir 21 has a forwardly projecting, concave front face 44 and a water conduit 46 extending from the front face 44 into the hollow interior of the reservoir 21. The present invention is concerned with a fill port assembly, generally designated 48, used in association with the water conduit 46 for pouring water into the water reservoir 21.

Figure 7:
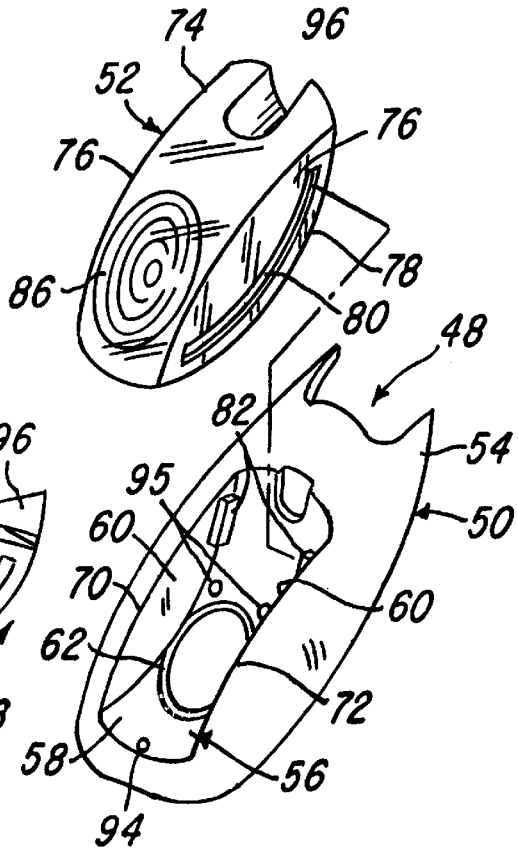
FIG. 7 is an exploded perspective view of the fill port assembly.

With reference to FIG. 7, the fill port assembly 48 comprises a pair of one-piece, injection molded parts: a fill port base 50 and a fill port cover 52. The fill port base 50 has a generally ovate front face 54 and a pocket 56 recessed into the front face 54. Pocket 56 generally has the form of a segment of a cylinder and, accordingly, has a concave bottom wall 58 having a cross-section which is an arc of a circle and also has mutually parallel and planar sidewalls 60 that have arcuate top and bottom edges identified by reference numbers 70 and 72 in FIG. 7. The rear surface of the bottom wall 58 generally matches the contour of the front face 44 of the water reservoir 21. A gasket 73, which can be made from a closed cell foam material, is preferably sandwiched between the bottom wall 58 and the front face 44 to prevent water from passing therebetween. A fill port 62 is centrally located between the sidewalls 60 and intermediate the upper and lower ends of the bottom wall 58. With reference to FIG. 2, plural connecting hooks 64 (only one of which is shown in FIG. 2) that engage cooperating parts of the iron handle 18 may be used to mount the fill port base 50 in a window 66 in the forward end of the handle 18 with the fill port 62 aligned with the water conduit 46 in the water reservoir front face 44.

The fill port cover 52 has a convex front wall 74 and a pair of sidewalls 76 that are substantially coextensive with the pocket sidewalls 60 and therefore have lower edges 78 which are also in the shape of a circular arc. Both cover sidewalls 76 have an arcuate slot 80 concentric with its associated lower edge 78. Slidable mounting of the fill port cover 52 on the fill port base 50 is provided by a mutually-confronting pair of arcuate guide ribs 82, one on each of the pocket sidewalls 60, that are slidably received within the sidewall slots 80. Stiffening ribs (not shown) may be located on the inside surfaces of the cover sidewalls 76. A shallow, finger-engageable recess 86 is formed in the lower portion of the front wall 74 of the fill port cover 52 to enable the fill port cover 52 to be easily moved arcuately upwardly relative to the base member 50.

Figure 3:
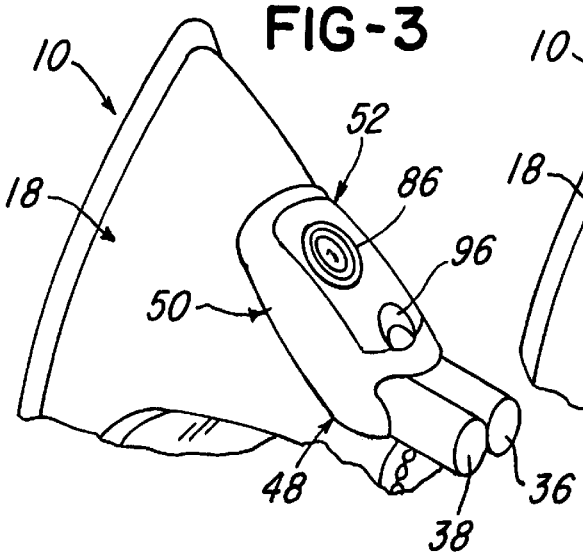
FIG. 3 is a fragmentary isometric view of the steam iron of FIG. 1 with the front end of the iron pointing upwardly and the fill port closed.
Figure 5:
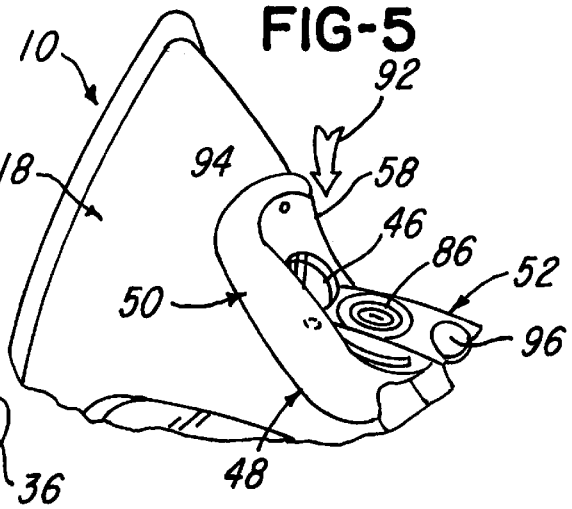
FIG. 5 is a fragmentary isometric view similar to FIG. 3 but with the fill port opened.
Figure 4:
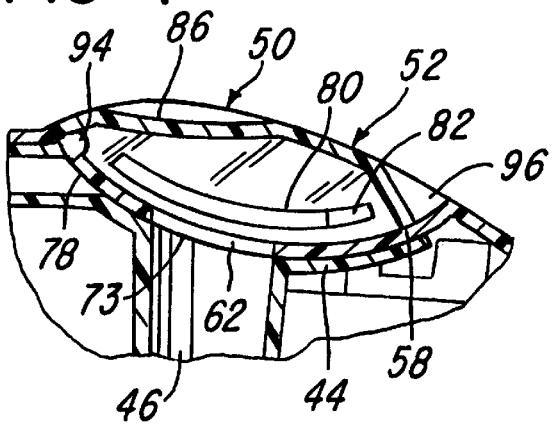
FIG. 4 is a fragmentary cross-sectional view of the parts shown in FIG. 3.
Figure 6:
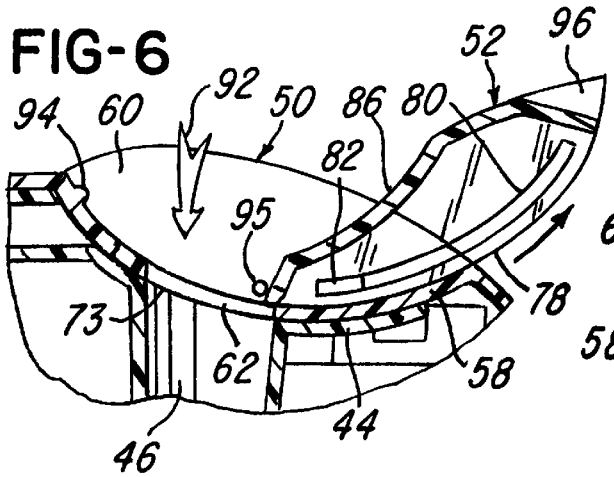
FIG. 6 is a fragmentary cross-sectional view of the parts as shown in FIG. 5.

As is evident from a comparison of FIGS. 3 and 4 with FIGS. 5 and 6, the fill port cover 52 is slidably mounted on the fill port base 50 for movement along an arcuate path from a first position shown in FIGS. 3 and 4 in which the cover 52 covers the fill port 62 upwardly to a second position shown in FIGS. 5 and 6 in which the fill port 62 is exposed to permit water to be poured through the fill port 62 into the reservoir conduit 46, as indicated by the arrows 92 in FIGS. 6 and 7.

In the raised position of the fill port cover 52 shown in FIGS. 5 and 6, the upper end of the fill port cover 52 projects both upwardly and forwardly from the fill port base 50. It will be observed that, with the iron 10 tilted upwardly as shown in FIGS. 5 and 6, the shallow recess 86 of the fill port cover 52 and the lower portion of the bottom wall 58 of the pocket 56 form a funnel for directing water into said fill port 62.

A projecting boss 94 at the lower end of the pocket bottom wall 58 frictionally resists upward movement of the cover 52 and thereby tends to retain the cover 52 in covering relation to the fill port 62. A pair of projecting bosses 95 located on the bottom wall 58 near the top of the fill port 62 engage the lowermost edge of the fill port cover 52 when in its raised position to support the cover 52. The bosses 94 and 95 are sufficiently small that the resistance to movement of the cover 52 provided thereby is easily manually overcome.

To permit normal use of the spray nozzle 40, the top of the fill port cover 52 is notched to provide an opening 96 through which water can be sprayed by the nozzle 40.

Although the presently preferred embodiment of this invention has been described, it will be understood that within the purview of the invention various changes may be made within the scope of the following claims.

Having thus described our invention, we claim:

1. A fill port assembly for a steam iron comprising: a fill port base member having a port-receiving pocket, said pocket having an arcuately concave bottom wall and mutually parallel sidewalls, a fill port located intermediate the upper and lower ends of said bottom wall; and a fill port cover slidably mounted on said sidewalls along an arcuate path from a first position in which said cover covers said fill port to a second position in which said cover is located above at least a portion of said fill port to enable water to be poured into said fill port, said cover having an upper end which in said second position projects upwardly and forwardly from said base member so that the front surface of said cover and said bottom wall form a funnel for directing water into said fill port.

2. The fill port assembly of claim 1 wherein said pocket has a vertical extent greater than its horizontal extent.

3. The fill port assembly of claim 1 wherein said bottom wall has a spray opening at its upper end, and wherein said cover has a recess in its upper end aligned with said spray opening when said cover is in said first position.

4. The fill port assembly of claim 1 wherein said bottom wall has forwardly projecting protuberances frictionally engaging said cover for resisting movement of said cover from said first position and for resisting movement of said cover from said second position to said first position.

5. The fill port assembly of claim 1 wherein said cover has a convex front surface and a finger-engageable depression adjacent its lower end.

6. The fill port assembly of claim 1 wherein said cover has a pair of mutually parallel side walls which are parallel to said sidewalls of said pocket, said cover side walls and said pocket sidewalls having mutually engaging guide members which restrict relative motion of said cover to an arcuate motion about the radius of said bottom wall of said pocket.

7. The fill port assembly of claim 6 wherein said sidewalls of said cover have arcuate slots concentric with said bottom wall of said pocket and said sidewalls of said pocket have bosses projecting into said slots.

8. A fill port assembly for a steam iron comprising: a fill port base located at the front of the steam iron and defining a fill port;

a fill port cover slidably mounted on said fill port base for movement along an arcuate path from a first position in which said cover covers said fill port to a second position in which said cover is located above at least a portion of said fill port to enable water to be poured into said fill port, said cover having an upper end which in said second position projects upwardly and forwardly form said base.

9. The fill port assembly of claim 8 wherein the front surface of said cover and surface portions of said base form a funnel for directing water into said fill port.

10. A fill port assembly for a steam iron comprising a fill port cover slidably mounted on said steam iron along an arcuate path from a first position in which said cover covers a fill port at the front of the steam iron to a second position in which said cover is located above at least a portion of said fill port to enable water to be poured into said fill port, said cover having an upper end which in said second position projects upwardly and forwardly from said fill port.

* * * * *